US010948176B1

(12) United States Patent
Johnston et al.

(10) Patent No.: US 10,948,176 B1
(45) Date of Patent: Mar. 16, 2021

(54) MIRROR WITH ILLUMINATED EXTRUDED FRAME

(71) Applicant: ELECTRIC MIRROR, LLC, Everett, WA (US)

(72) Inventors: Jon Philip Johnston, Edmonds, WA (US); Patrick Daniel Erickson, Seattle, WA (US)

(73) Assignee: ELECTRIC MIRROR, LLC, Everett, WA (US)

( * ) Notice: Subject to any disclaimer, the term of this patent is extended or adjusted under 35 U.S.C. 154(b) by 0 days.

(21) Appl. No.: 16/370,146

(22) Filed: Mar. 29, 2019

Related U.S. Application Data

(60) Provisional application No. 62/649,831, filed on Mar. 29, 2018.

(51) Int. Cl.

| | |
|---|---|
| ***F21V 33/00*** | (2006.01) |
| ***F21V 3/04*** | (2018.01) |
| ***A47G 1/02*** | (2006.01) |
| ***A47G 1/06*** | (2006.01) |
| ***F21V 23/00*** | (2015.01) |

(52) U.S. Cl.
CPC ..... *F21V 33/0024* (2013.01); *A47G 1/02* (2013.01); *A47G 1/0622* (2013.01); *F21V 3/049* (2013.01); *F21V 23/002* (2013.01)

(58) Field of Classification Search
None
See application file for complete search history.

(56) References Cited

U.S. PATENT DOCUMENTS

| | | | | |
|---|---|---|---|---|
| 2,313,838 | A * | 3/1943 | Nordquist | A47G 1/02 362/140 |
| 2,876,056 | A | 3/1959 | Berger | |
| 2,947,093 | A | 8/1960 | Masters | |
| 2,986,282 | A * | 5/1961 | Brink | A47G 1/02 108/152 |
| 8,356,908 | B1 | 1/2013 | Zadro | |
| 9,765,958 | B2 | 9/2017 | Lumaye | |
| 2013/0120969 | A1 | 5/2013 | Rensmo | |
| 2014/0198488 | A1 | 7/2014 | Schlueter | |
| 2014/0268715 | A1* | 9/2014 | Boyer | F21V 7/0008 362/217.05 |
| 2015/0107142 | A1* | 4/2015 | Burrous | A47G 1/0622 40/714 |
| 2016/0252218 | A1 | 9/2016 | Fujikawa | |

* cited by examiner

*Primary Examiner* — Vip Patel
(74) *Attorney, Agent, or Firm* — Peloquin, PLLC; Mark S Peloquin, Esq.

(57) ABSTRACT

Extruded frame members are connected together to create a frame around a mirror that be illuminated from in front of the mirror. The extruded frame members contain various components in channels or cavities. An extruded frame member can have a channel that contains a light source. A diffuser can be secured over the light source. Another channel is used to hold a mirror in place. The front lit mirror can be hung on a wall utilizing a channel in an extruded frame member. The extruded frame members contain electrical components and mechanical hardware. The hardware is used to attach a plurality of extruded frame members together and to attach an optional decorative frame to an extruded frame member. An extruded frame member is made from transparent or translucent material and can radiate light from a light source contained therein. An extruded frame member is opaque and cannot radiate light.

35 Claims, 17 Drawing Sheets

MIRROR WITH ILLUMINATED EXTRUDED FRAME

RELATED APPLICATIONS

This application claims priority from U.S. Provisional Patent application No. 62/649,831, filed on Mar. 29, 2018, entitled "MIRROR WITH ILLUMINATED EXTRUDED FRAME." U.S. Provisional Patent application No. 62/649,831 is hereby fully incorporated by reference.

BACKGROUND OF THE INVENTION

1. Field of Invention

The invention relates generally to mirrors, framed mirrors, and framed lighted mirrors.

2. Art Background

Lighted mirrors are typically understood as a mirrors that are manufactured in such a way as to allow a light source behind the mirror to shine through the mirror's surface. A typical lighted mirror is composed of a mirror, a chassis, and electrical components. The chassis is a metal structure that can be mounted to a wall, houses electrical components, and with which the mirror is supported. Problems exist where the chassis' depth needs to be deep enough to house the components, which in turn prevents the mirror from being as close to flush to the wall as possible. This presents a problem. Controlling the directionality of a light behind a mirror, relative to a person using the mirror is difficult. This presents a problem. More energy is required to create a given illumination on a front side of a mirror when the light is required to pass through the mirror glass. This presents a problem.

BRIEF DESCRIPTION OF THE DRAWINGS

The invention may best be understood by referring to the following description and accompanying drawings that are used to illustrate embodiments of the invention. The invention is illustrated by way of example in the embodiments and is not limited in the figures of the accompanying drawings, in which like references indicate similar elements.

DETAILED DESCRIPTION

In the following detailed description of embodiments of the invention, reference is made to the accompanying drawings, in which like references indicate similar elements, and in which is shown by way of illustration, specific embodiments in which the invention may be practiced. These embodiments are described in sufficient detail to enable those of skill in the art to practice the invention. In other instances, well-known circuits, structures, and techniques have not been shown in detail in order not to obscure the understanding of this description. The following detailed description is not to be taken in a limiting sense and the scope of the invention is defined only by the appended claims.

In one or more embodiments, methods, and apparatuses are described that provide a mirror enclosed by a frame, where the frame is made from extruded frame members. The frame contains in various embodiments, a light source, electrical components, connecting components, a light diffuser, and a channel that allows it to be hung on a wall with a wall-mounted cleat, thereby providing an illuminated frame in the form of a front lit mirror.

Figure 1:
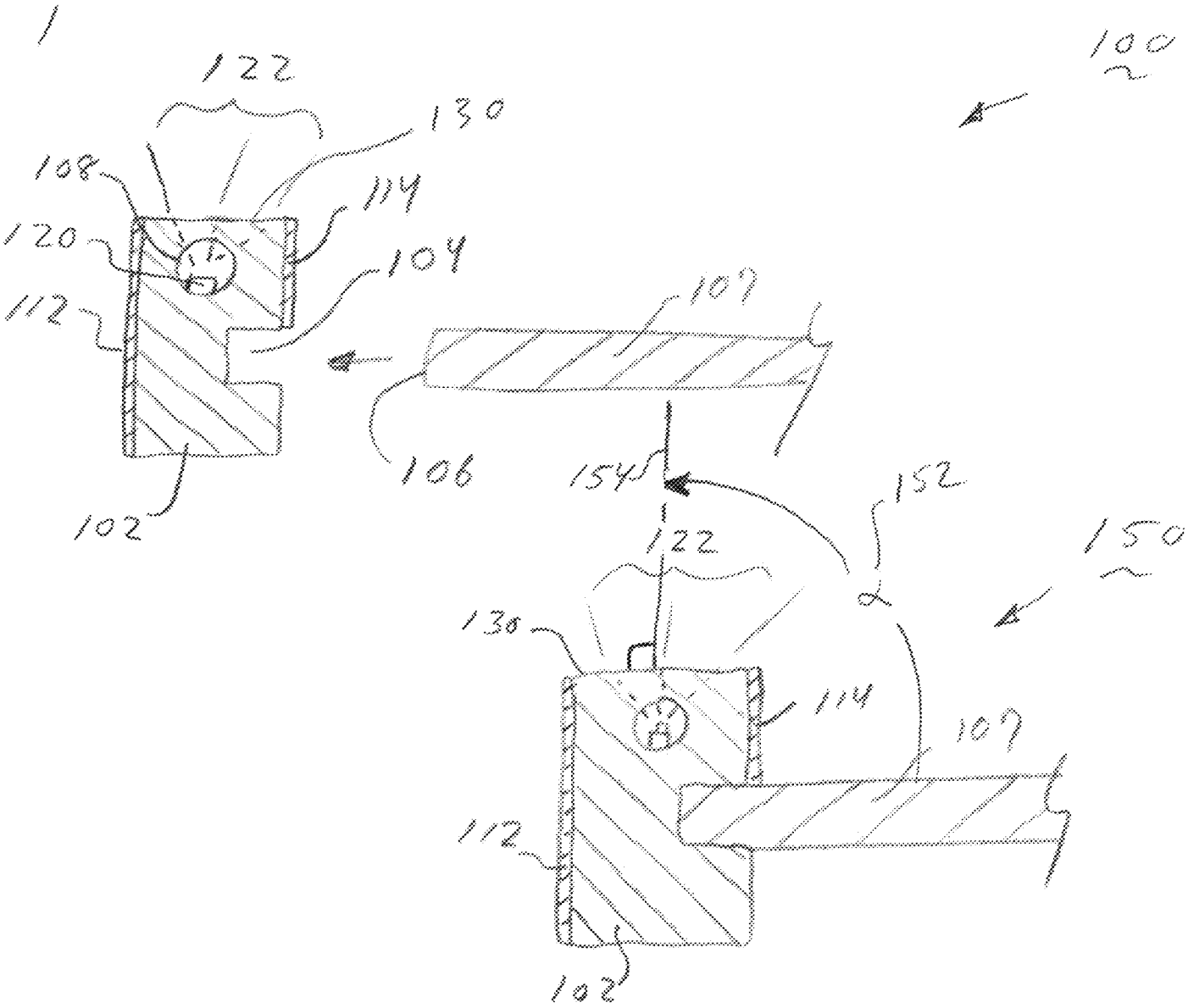
FIG. 1 illustrates a profile view of a translucent extruded frame member, according to embodiments of the invention.

FIG. 1 illustrates a profile view of a translucent extruded frame member, according to embodiments of the invention. With reference to FIG. 1, an extruded frame member 102 is illustrated in profile view. The extruded fame member 102 has a longitudinal extent into and or out of the plane of the FIG. 1. Such similar longitudinal extent is illustrated in the perspective view of an extruded frame member 602 shown in FIG. 6 below. The extruded frame member 102 has a mirror channel 104 formed therein. The mirror channel 104 is configured to receive an edge 106 of a mirror 107 when the mirror 107 is assembled with one or more extruded frame members, one of which is illustrated by extruded frame member 102. View 150 illustrates the mirror 107 assembled with the extruded frame member 102. As used in this description of embodiments, the term "channel" is used to refer to a shape within a profile of an extruded member that has an opening with respect to the profile of the extruded member. For example, in the profile view illustrated in 100 the mirror channel 104 has an opening that can receive the end 106 of the mirror 107.

The extruded frame section 102 has a cavity 108 formed therein. The cavity 108 has longitudinal extent along the length of the extruded frame member 102 similar to the longitudinal extent of the channel 104. As used in this description of embodiments, the term "cavity" is used to refer to a shape within a profile of an extruded member that does not have a continuous opening along a longitudinal direction of the extruded frame member. A light source 120 is inserted into the cavity 120 and extends longitudinally along the extruded frame member 102. Those of skill in the art will appreciate that when a profile view is shown, such as in FIG. 1, longitudinal extent of the profile implies extent either into or out of the plane of the figure. The extruded frame member 102 is made from either a transparent or a translucent material that permits light to pass therethrough. When the extruded frame member 102 is made from a translucent material, the extruded frame member diffuses the light 122 emitted by the light source 120. In some embodiments, the only diffuser used is the extruded frame member 102 itself. In other embodiments, a supplemental diffuser (not shown) is applied between the extruded frame member and a user of the front lit mirror. In some embodiments, the supplemental diffuser is applied to an outer illuminated surface 130 of the extruded frame member 102.

In some embodiments, one or more opaque materials 112 and 114 are located as shown proximate with or attached to the extruded frame member 102. The opaque material 112 and/or 114 prevent light from radiating from the extruded frame member 102 over the surfaces covered thereby. In various embodiments, the extruded frame member 102 is made from a plastic, or other transparent or translucent extrudable material.

View 150 illustrates, an angle α indicated at 152. Angle 152 is the angle that exists between a plane of the mirror 107 and a reference line 154 placed normal to the outer illuminated surface 130. In various embodiments, the outer illuminated surface 130 is tilted such that angle 152 can be varied to less than 90 degrees, or more than 90 degrees, or equal to 90 degrees. No limitation is implied by angle 152 as illustrated in FIG. 1 and the orientation illustrated is provided merely as an example of one embodiment made from an extrusion process setup to produce the angle shown at 152.

The light source 120 or any of the other light sources illustrated in the figures that follow are either distributed light sources or discrete light sources. In some embodiments, alight source is made from an array of light emitting diodes (LED). In other embodiments, organic light emitting diodes (OLED) are used. In other embodiments, other solid-state technology is used to make the light source. In some embodiments, one or more incandescent bulbs are used for a light source. Embodiments, of the invention are made with different types of light sources. The type of light source or the technology used to make a light source does not limit embodiments of the invention. When reference is made to LED in this embodiment, such reference will be understood to set forth an example and is not intended to impose any limitation thereby.

Figure 2:
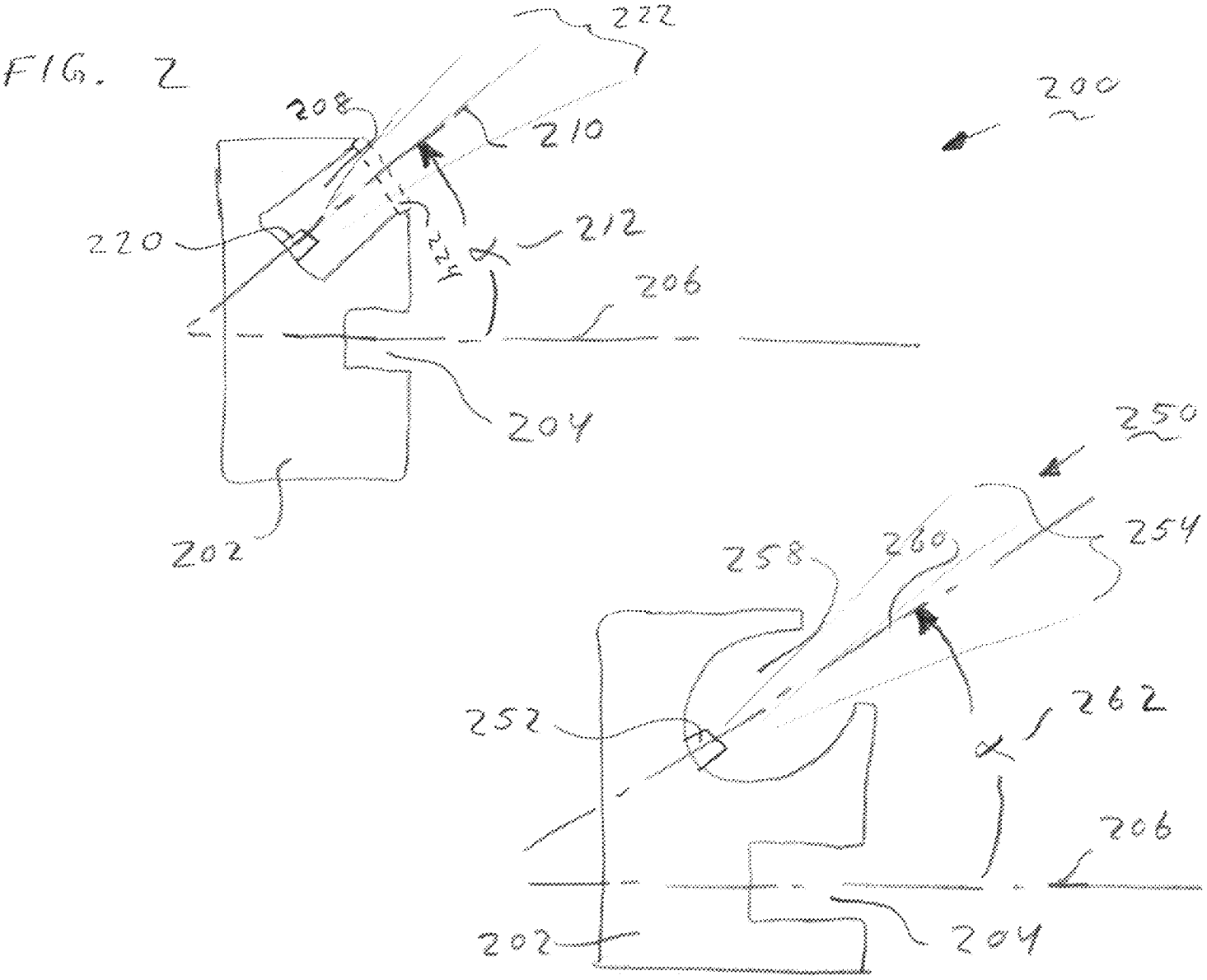
FIG. 2 illustrates a profile view of an extruded frame member, according to embodiments of the invention

FIG. 2 illustrates, a profile view of an extruded frame member, according to embodiments of the invention. With reference to FIG. 2, an extruded frame member 202 is illustrated in profile view at 200. The extruded fame member 202 has a longitudinal extent into and or out of the plane of the FIG. 2. Such similar longitudinal extent is illustrated in the perspective view of an extruded frame member 602 shown in FIG. 6 below. The extruded frame member 202 has a mirror channel 204. The mirror channel 204 is configured to receive a mirror such as the mirror 107 illustrated in FIG. 1. No mirror is presented in FIG. 2 to preserve clarity within the illustration. A light source channel 208 is also provided in the extruded frame member 202. Both the mirror channel 204 and the light source channel 208 extend along a longitudinal direction of the extruded frame member 202.

A light source 220 is placed within the light source channel 208. The light source 220 radiates light 222 in a direction designed to illuminate a user when the user stands in front of the front lit mirror that is made with the extruded frame member 202 described herein. The light source channel 208 is configured within the extruded frame member 202 such that a side of the light source channel 208 makes an angle α indicated at 212 with a plane 206 corresponding to a plane of a mirror that would be installed into the mirror channel 204. Note that reference line 210, used to describe angle α, is substantially parallel to the sides of the light source channel 208. In various embodiments, during manufacture of the extruded frame member 202, the light source channel can be configured at any of a variety of desired angles such that α, indicated at 212, can span a range from zero (0) to one hundred and eighty (180) degrees. The acute angle chosen for α, in FIG. 2 at 212, illustrates one embodiment and does not limit other embodiments of the invention.

An optional diffuser 224 is installed at the aperture of the light source channel 208 in some embodiments. When installed over the aperture of the light source channel 208, the diffuser 224 diffuses light radiated from the light source 220, when in an "ON" state, thereby providing a pleasant softening of the light such that the point sources of light are not visible by a user viewing the extruded frame member 202 from a front side of a front lit mirror made with the extruded frame member 202.

The light source channel 208 can be configured with parallel sides or substantially parallel sides as shown in 200 or the light source channel can be configured with other shapes such as the curved shape illustrated by alight source channel 258 in view 250. A light source 252 is located within the light source channel 258. In an "ON" state the light source 252 radiates light 254 such that a user viewing a front lit mirror made with the extruded fame member 202 would be illuminated thereby.

With reference to view 250, the light source channel 258 is configured within the extruded frame member 202 such that an axis 260 through the light source channel 208 makes an angle α indicated at 262 with a plane 206 corresponding to a plane of a mirror that would be installed into the mirror channel 204. In various embodiments, during manufacture of the extruded frame member 202, the light source channel can be configured at any of a variety of desired angle such that α, indicated at 262, can span a range from zero (0) to one hundred and eighty (180) degrees. The acute angle chosen for α, in FIG. 2 at 262, illustrates one embodiment and does not limit other embodiments of the invention.

An optional diffuser can be used over the aperture of the light source channel 258 as illustrated above in view 200. In various embodiments, the extruded frame member 202 is made from an opaque material such as aluminum, plastic or another extrudable material. When an opaque material is used for the extruded frame member, light is confined to radiate from an aperture of the light source channel.

The extruded frame members described above in conjunction with FIG. 1 and FIG. 2 are used either individually or in combination to make one or a plurality of front lit mirror components. One or more front lit mirror components are assembled together with a mirror to provide a front lit mirror for use by a user who views herself or himself from a front side of the front lit mirror. In some embodiments, the extruded frame members are curved, and a mirror used with the curved extruded frame members is likewise curved such that when an edge of the curved mirror is inserted into a mirror channel a frame is constructed around a perimeter of the mirror. Embodiments, of the invention are used to create front lit frames for mirrors having a variety of shapes, such as but not limited to a square shape, a rectangular shape, a round shape, a hexagonal shape or multisided shape, or a general curved shape.

Figure 3:
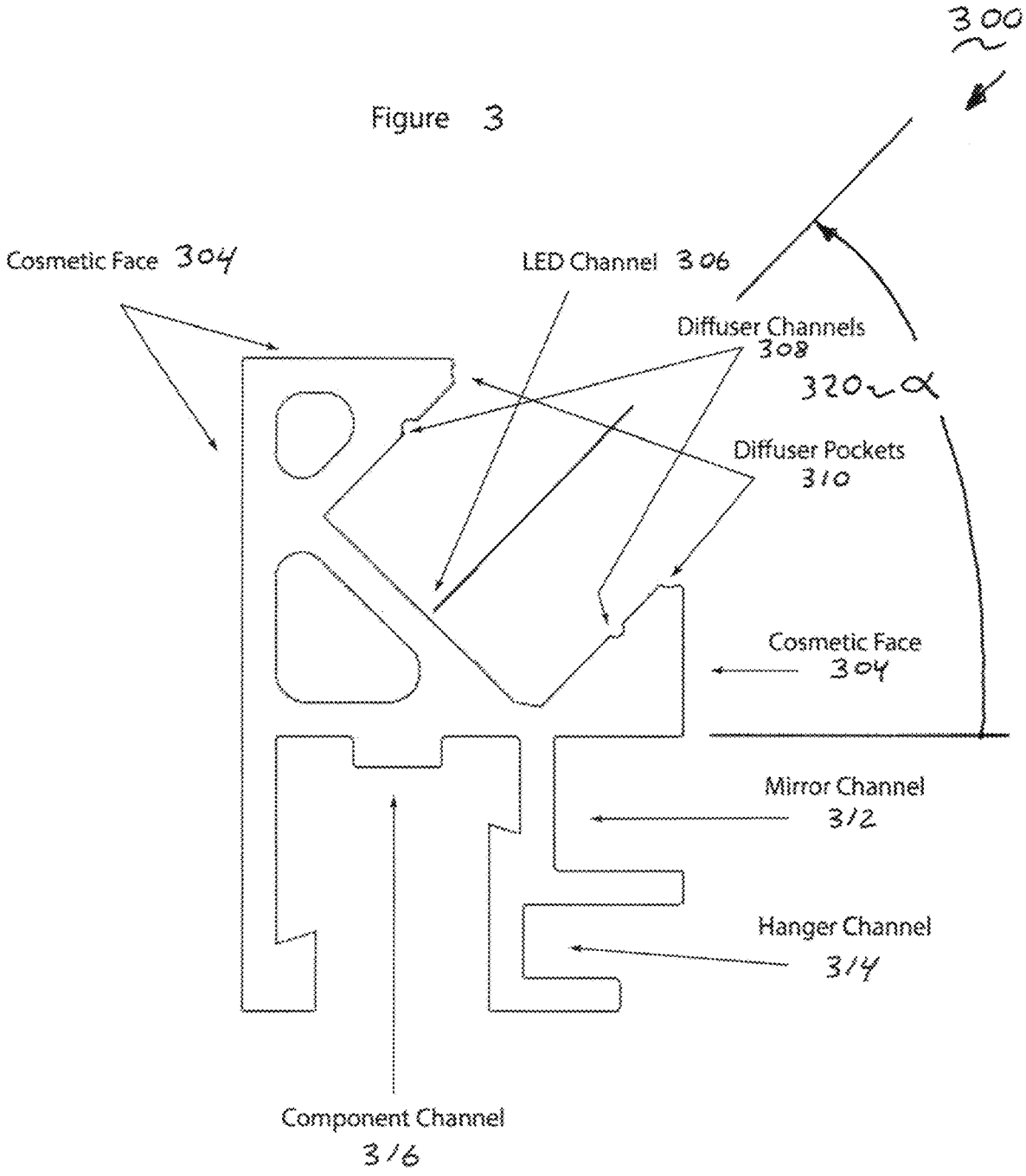
FIG. 3 illustrates another extruded frame member in profile view, according to embodiments of the invention.

The description that follows using FIG. 3 through FIG. 17 is given by way of example only. Note that any other profile shapes of an extruded frame member, such as but not limited to, those shown in FIG. 1 or FIG. 2 above can be substituted or combined with the profile shown in FIG. 3 to make a front lit mirror. FIG. 3 illustrates, generally at 300, another extruded frame member in profile view, according to embodiments of the invention. With reference to FIG. 3, a profile view of an extruded frame member shows, in various embodiment, the many different angles and channels which allow the extruded frame member to function as the foundational structure of a front-lit lighted mirror. During manufacture, an extrusion die creates extruded sticks, herein referred to synonymously as extruded frame members, shaped in profile as illustrated in any of FIG. 1, FIG. 2, FIG. 3, etc. which in turn are cut at angles to allow adjacent ends of two extruded frame members to be joined together. For example, if a rectangular mirror is being designed, then the ends of the extruded sticks, along with a diffuser, for example as shown in FIG. 6 at 612 are cut at 45-degree angles to allow four of them to fit together to form a rectangular shape. A square shaped or curved shape front lit mirror is made by following a similar procedure.

The extruded frame member 302 has one or more cosmetic faces 304. Cosmetic faces 304 are surfaces that a user will see after the front lit mirror is assembled. A light source channel 306 illustrates a channel in the extrusion where an LED strip is mounted. Diffuser channels 308 illustrates two small channels within the LED Channel that secure the diffuser to the extruded frame member 302. Diffuser pockets 310 illustrates two small channels on the outside edges of the LED channel that allow a diffuser to seamlessly connect to the cosmetic faces 304. A mirror channel 312 illustrates the channel that a mirror fits into during assembly. A hanger channel, 314 illustrates the channel of the extruded frame member 302 that is used to hang the front lit mirror assembly on a mounting device, such as a wall cleat described below. A component channel 316 illustrates the channel that contains wiring, latex tubing, etc. to secure wiring, channel brackets for decorative frames, and L-brackets to secure each extrusion stick to a neighboring extrusion stick when constructing a frame. As illustrated in FIG. 3, the extruded frame member contains two small channels, two pockets (pockets are referred to herein synonymously as cavities), and four large channels.

Figure 4:
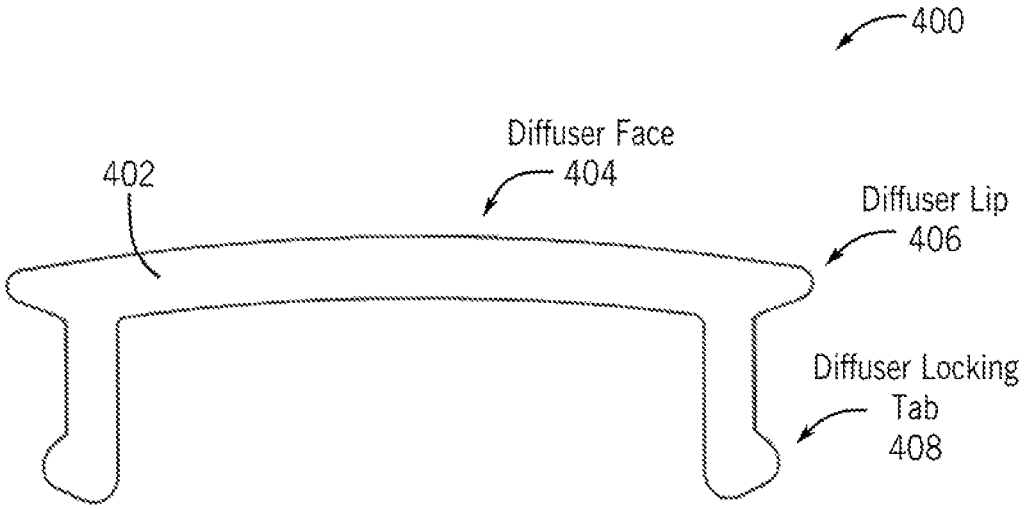
FIG. 4 illustrates a profile view of a diffuser, according to embodiments of the invention.
Figure 14:
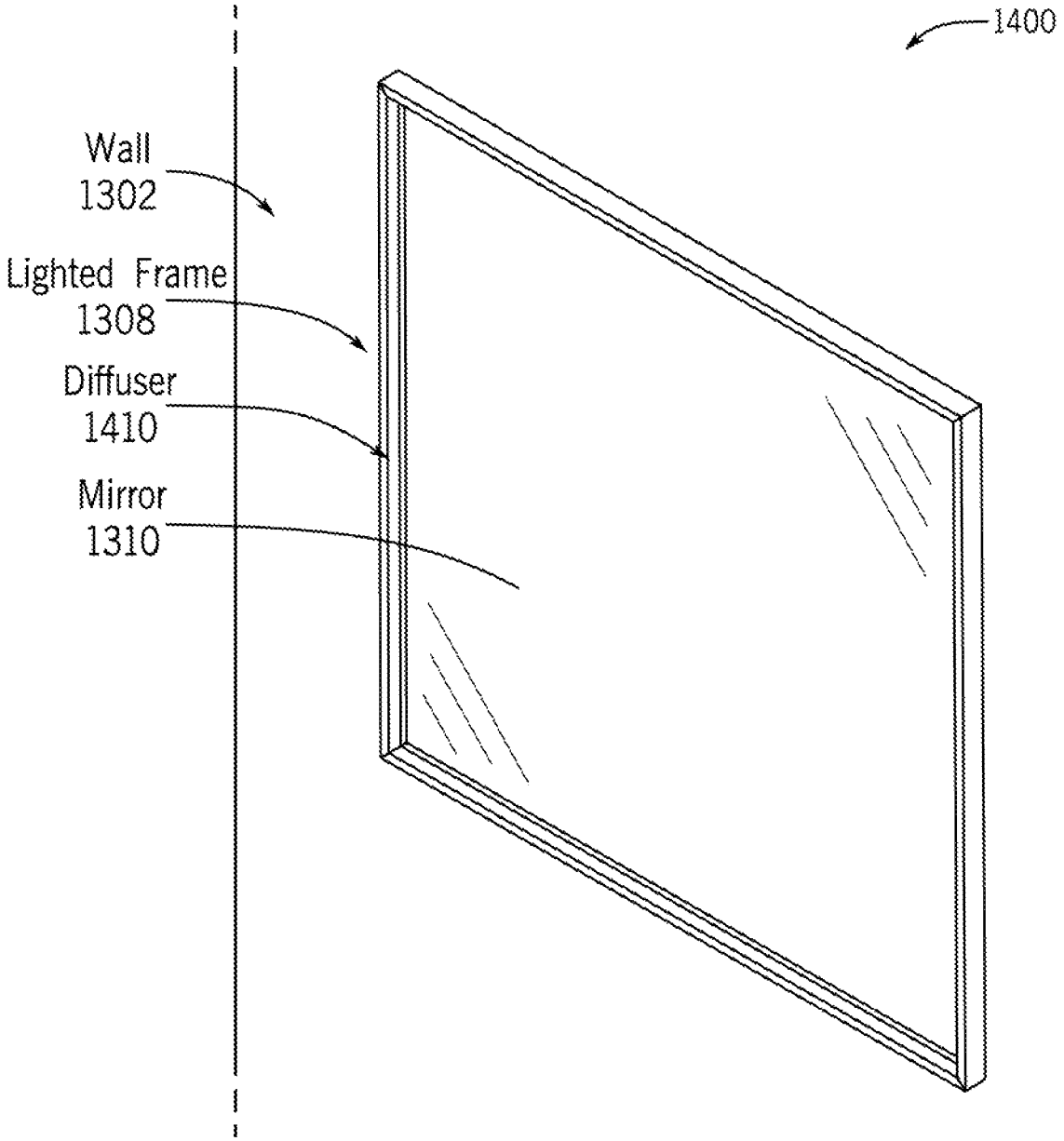
FIG. 14 illustrates an assembled front lit mirror product, according to embodiments of the invention.

FIG. 4 illustrates, generally at 400, a profile view of a diffuser according to embodiments of the invention. A diffuser 402, shown in profile, has longitudinal extent either into or out of the plane of the figure and such longitudinal extent can be seen in the perspective view presented in FIG. 6. In various embodiments, the diffuser 402 is made from plastic and is designed to diffuse the light radiated from a light source located behind the diffuser so that the discrete light source elements are not visible to a viewer viewing a front side of a front lit mirror made using the diffuser 402. The diffuser 402 has a diffuser face 404 which indicates the cosmetic face of the diffuser 402 that a user sees. A diffuser lip 406 is an edge that protrudes from each side of the diffuser 402. A diffuser locking tab 408 is located on each side of the diffuser 402 and is a protruding tab that locks the diffuser 402 to the light source channel in an extruded frame member, by engaging with the diffuser channels, such as diffuser channel 308 in FIG. 3. The two small diffuser channels 308 allow the diffuser's locking tabs illustrated at 408 in FIG. 4 to hold the diffuser 402 in place. In various embodiments, the diffuser 402 is made of a translucent material that allows light to shine through it without the actual LED strip being visible, as illustrated at 1406 in FIG. 14 showing plastic diffusers affixed in a rectangle or square frame.

The diffuser pockets 310 illustrated in FIG. 3 receive the diffuser lip 406 illustrated in FIG. 4, which allows the diffuser face 404 illustrated in FIG. 4 to fit seamlessly against the extrusion's cosmetic faces 304 illustrated in FIG. 3.

Figure 5:
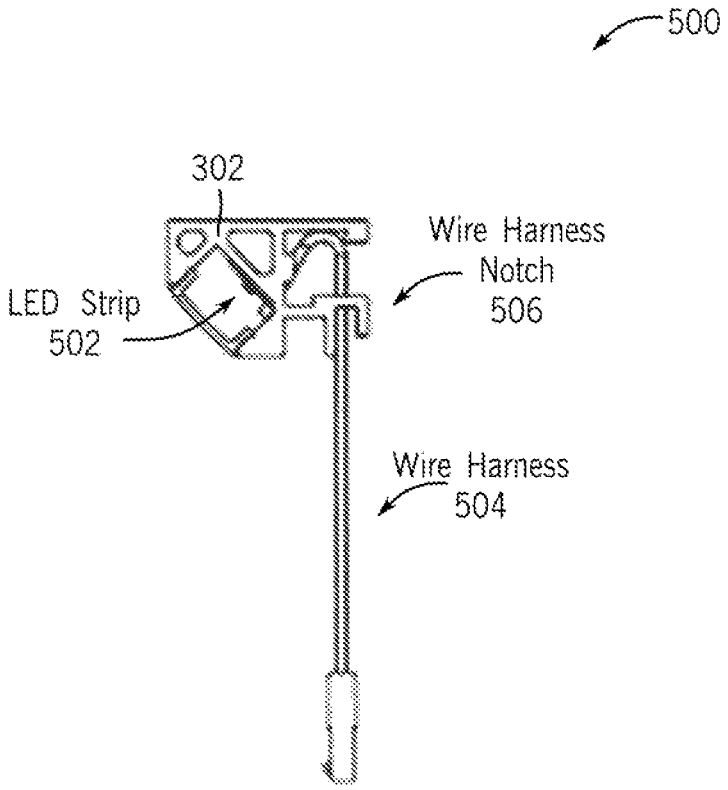
FIG. 5 illustrates lighting components in a profile view, according to embodiments of the invention.
Figure 6:
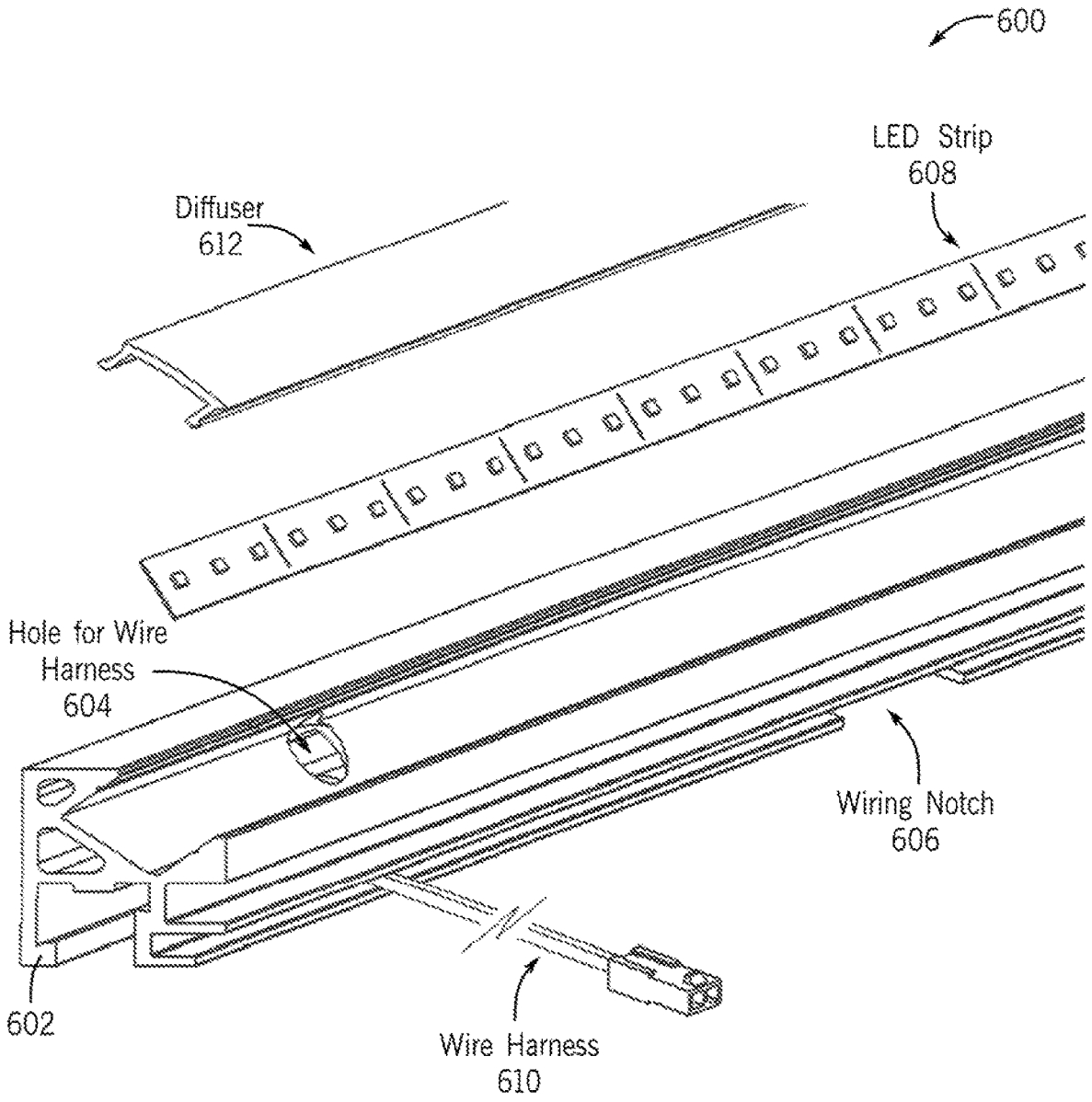
FIG. 6 illustrates an extruded frame member with associated components in perspective view, according to embodiments of the invention.

FIG. 5 illustrates, generally at 500, lighting components in a profile view, according to embodiments of the invention. With reference to FIG. 5, the extruded frame member 302 is configured with a wire harness 504 and a light source indicated as LED strip 502. The wire harness 504 is electrically connected to the LED strip 502 to provide a source of electrical power. The extruded frame member 302 is equipped with one or more wire harness notches 506 at an appropriate location along its length to permit the wire harness notch 506 to accommodate a thickness of the wire harness 504 which will permit the extruded frame members to be mounted flush against a mounting surface such as a wall, for example. The wire harness notch 506 and associated components, illustrate a wire harness routed through a hole in the extruded frame member thereby permitting the wire harness to come from the LED strip and pass through a notch in the hanger channel, an example of which is illustrated in the figures below.

FIG. 6 illustrates, generally at 600, an extruded frame member with associated components in perspective view, according to embodiments of the invention. With reference to FIG. 6, a portion of an extruded frame member 602 is illustrated showing its longitudinal extent. A light source is indicated as LED strip 608. A wiring notch 606 is created in the extruded frame member 602 at a desirable location in the hanger channel of the extruded frame member 602. A portion of a wire harness is illustrated at 610. 604 is a hole for the wire harness and illustrates a location for a hole in the extruded frame member 602 that allows the wire harness 610 to pass through to reach the LED strip 608 after the LED strip 608 installed in the light source channel. A diffuser is indicated at 612. After the LED strip 608 is mounted in the light source channel the diffuser 612 is placed in the aperture of the light source channel, an example following assembly is shown in the profile view of FIG. 5.

Figure 7:
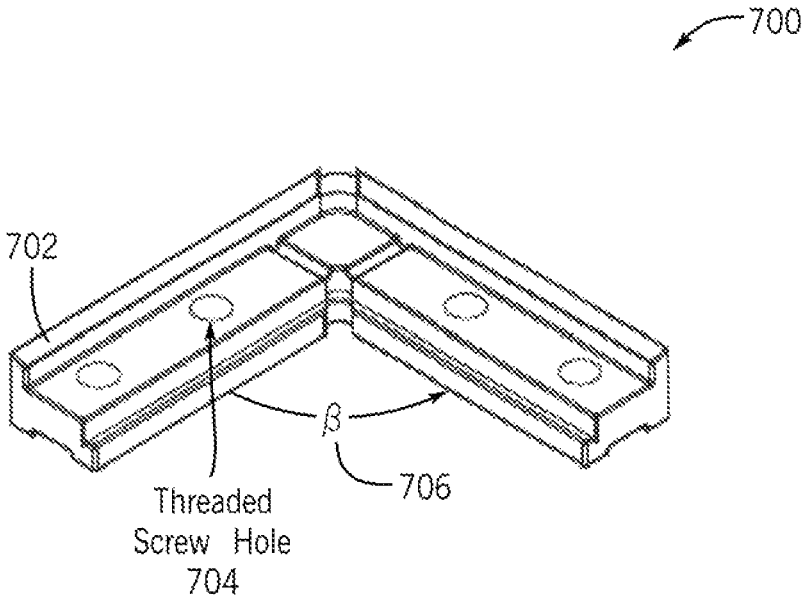
FIG. 7 illustrates a bracket in perspective view, according to embodiments of the invention.

FIG. 7 illustrates, generally at 700, a bracket in perspective view according to embodiments of the invention. With reference to FIG. 7, a bracket 702 is configured to receive a first extruded frame member on a first leg and then a second extruded frame member on a second leg. Threaded holes 704 permit each of the two extruded frame members to be securely fastened to the bracket 702. Note that the two legs of the bracket 702 define an angle β indicated at 706. In some embodiments, the angle indicated at 706 is a right angle (90 degrees) and such a bracket can be referred to as an L-bracket. In other embodiments, the angle indicated at 706 differs from 90 degrees. In various embodiments the angle indicated at 706 can be greater than 90 degrees or less than 90 degrees.

Figure 8:
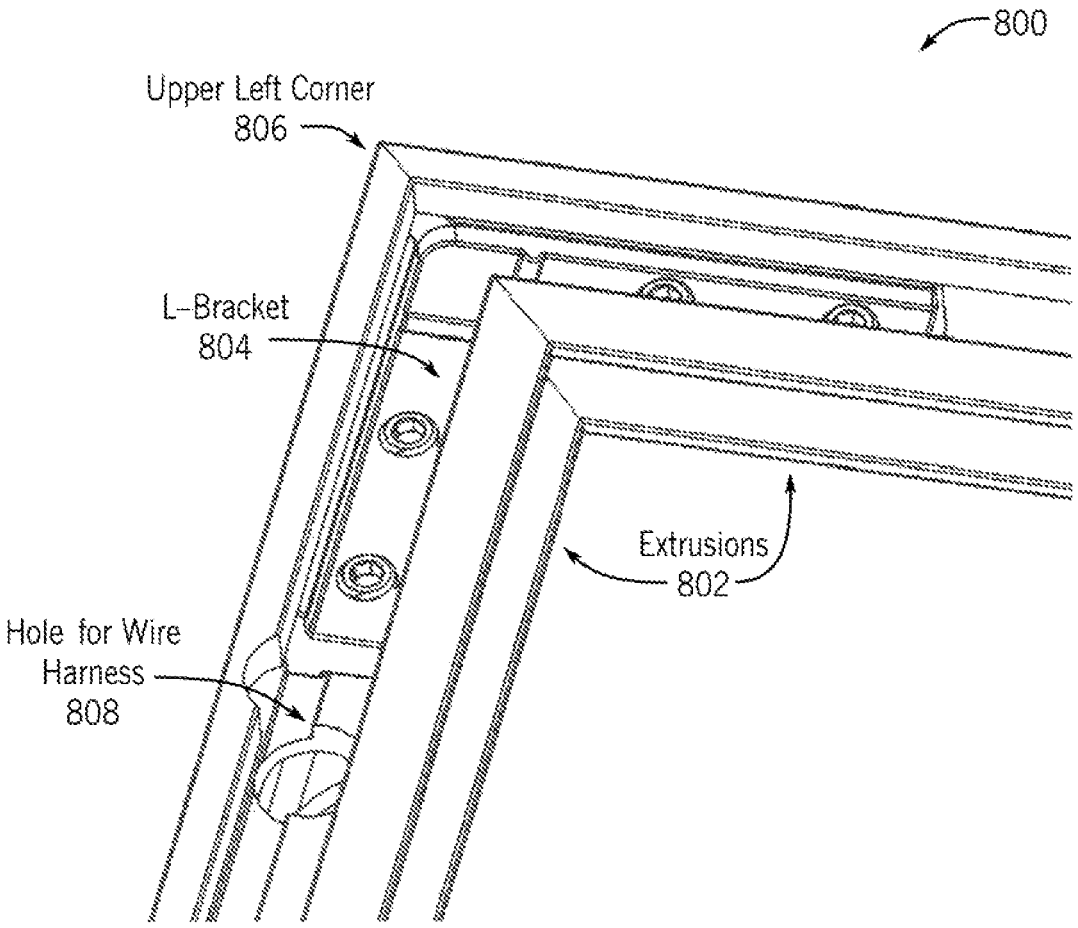
FIG. 8 illustrates use of an L-bracket, according to embodiments of the invention.

FIG. 8 illustrates, generally at 800, use of an L-bracket according to embodiments of the invention. With reference to FIG. 8, two corners of adjacent extruded frame members 802 are connected with an L-bracket 804 fastening together the two extruded frame members 802 at an upper left corner 806 of a front lit mirror. A hole 808 is illustrated in one of the extruded frame members. The hole 808 is used to permit a wire harness connected to a light source strip (neither of which are shown to preserve clarity in the illustration) to pass therethrough.

In yet other embodiments, a front lit mirror in constructed with one or more L-brackets and one or more brackets that are not L-brackets. In some embodiments, the bracket 702 is straight. In yet other embodiments, the bracket 702 is curved. In some embodiments, extruded frame members are curved and are joined together with curved brackets. In some embodiments, the extruded frame members are flexible and are bent around to capture thereby an edge of a mirror in a mirror channel. In such cases, a bracket can be straight, or curved, or can have its legs set at angle. Thus, a variety of shapes of mirrors are accommodated by different bracket geometry and extruded frame members.

Note that the LED Channel 306 illustrated in FIG. 3 contains diffuser channels 308 and diffuser pockets 310. An LED lighting strip is illustrated at 502 in FIG. 5 or at 608 in FIG. 6. A hole, e.g., 808 in FIG. 8 is drilled through from the component channel 316 as illustrated in FIG. 8. In one embodiment, the hole 808 is located on each extruded frame member near an end of each extruded frame member. The purpose of the hole is to allow a wire harness, illustrated in any of FIG. 5, FIG. 6, etc. to be passed through the component channel to the LED channel, in order for the harness to be connected to an LED strip. As shown in FIG. 3, the LED channel is at an angle relative to the mirror surface, which allows light to shine on a person's face, hair, body, and clothes in a bright and flattering manner.

Figure 9:
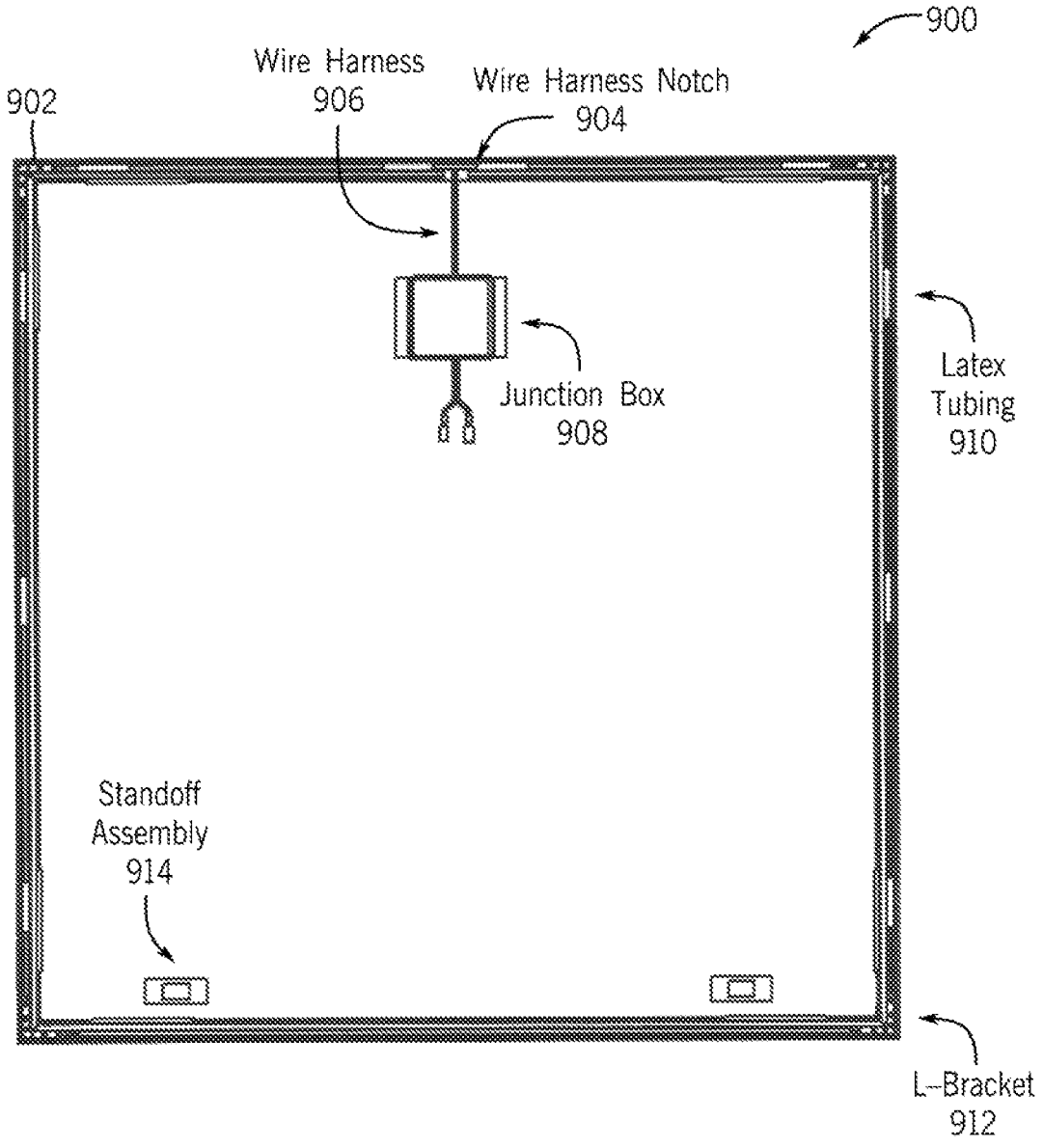
FIG. 9 illustrates components on a back side of an assembled front lit mirror, according to embodiments of the invention.

FIG. 9 illustrates, generally at 900, components on a back side of an assembled front lit mirror, according to embodiments of the invention. With reference to FIG. 9, a plurality of extruded frame components are assembled together to provide a frame for a front lit mirror as indicated at 902. A wire harness notch 904 is provided in an extruded frame section as previously described in the figures above to permit a wire harness 906 to exit a component channel of an upper extruded frame member such that the wire harness can extend to a junction box 908. The wire harness 906 is held within the component channel of the extruded frame members with fastening devices such as sections of latex tubing 910. Fastening devices 910 enable the wire harness to be held fast while permitting easy removal if required. The wire harness 906 connects to each light source, such as LED strips, to provide power to the light sources. L-brackets are used on each corner to secure adjacent extruded frame members together in the corners of the completed frame. For clarity in the illustration, only the L-bracket used at the lower right-hand corner is shown and it is labeled as 912. Standoff assembly 914 is used to hold the lower part of a front lit mirror assembly the same distance from the wall as the top portion of the mirror assembly and can be made adjustable as required. In some embodiments, the junction box 908 is used to connect the wiring harness 906 from the LED strips to the wire harness that connects to the LED driver.

Figure 10:
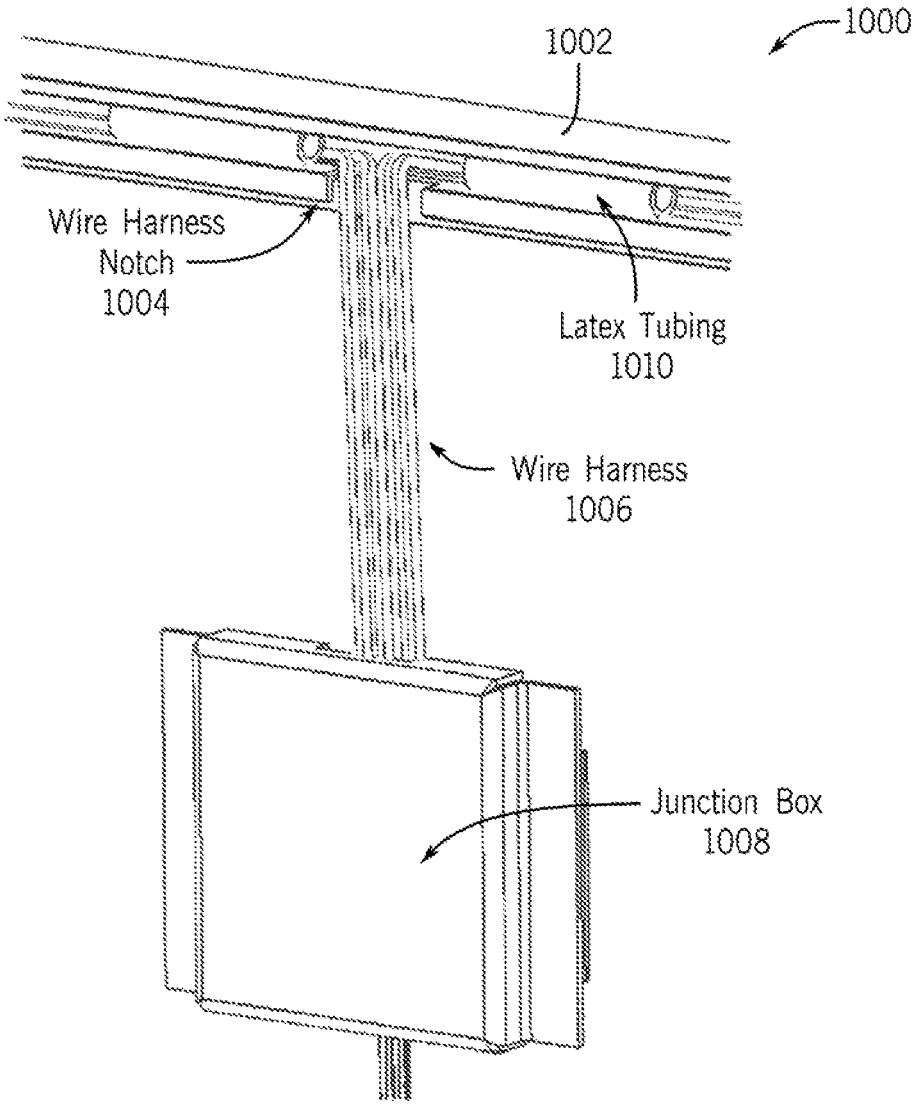
FIG. 10 illustrates a close-up view of a wire harnesses exiting from a component channel, according to embodiments of the invention.

FIG. 10 illustrates, generally at 1000, a close-up view of a wire harness exiting from a component channel, according to embodiments of the invention. With reference to FIG. 10, an extruded frame member 1002 is configured with a wire harness 1006 inside of a component channel of the extruded frame member 1002. A wire harness notch 1004 is provided in the extruded frame member 1002 to permit the wire harness 1006 to exit the component channel and extend to the junction box 1008. The wire harness 1006 is captured in the component channel and is prevented from falling out by one or more fastening devices such as segments of latex tubing indicated at 1010.

Figure 11:
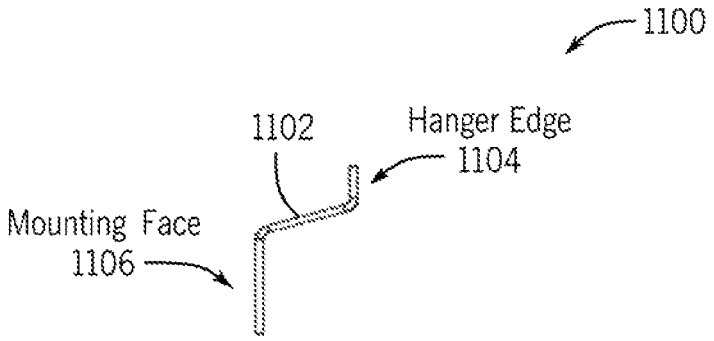
FIG. 11 illustrates use of a cleat for wall mounting, according to embodiments of the invention.

FIG. 11 illustrates, generally at 1100, use of a cleat for wall mounting, according to embodiments of the invention. With reference to FIG. 11, a mounting cleat 1102 is illustrated in profile view. The mounting cleat has a hanger edge 1104 and a mounting face 1106. A hanger channel created in an extruded frame member, such as 314 (FIG. 3), fits over the hanger edge 1104. The mounting face 1106 is mounted flush to a wall or other surface that the front lit mirror is being installed on. The completed front lit mirror is "hung" on the hanger edge 1104. In some installations a space exists between a top of a front lit mirror and the wall. In such situations, the standoff assembly 914 (FIG. 9) is adjusted as needed to make the space at the bottom of the mirror frame similar to a space at the top of the mirror frame.

Figure 12:
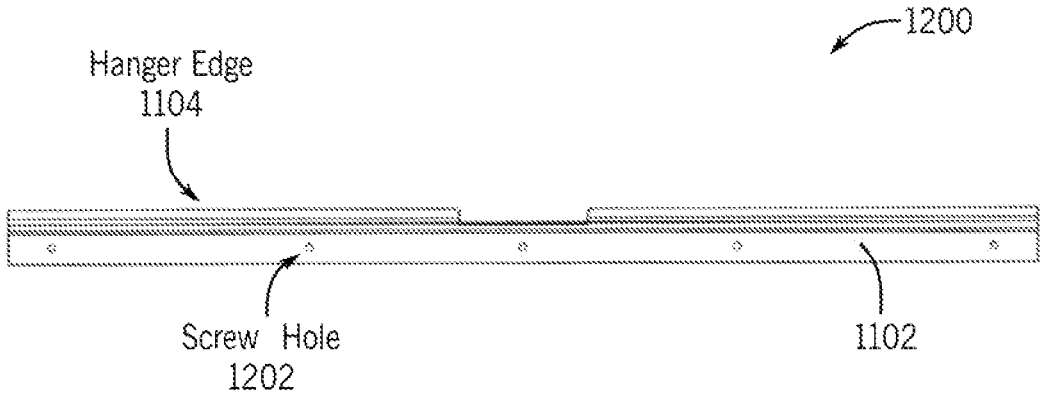
FIG. 12 illustrates a front view of a wall cleat, according to embodiments of the invention.

FIG. 12 illustrates, generally at 1200, a front view of a wall cleat according to embodiments of the invention. With reference to FIG. 12, the wall cleat 1102 (FIG. 11) is illustrated with the hanger edge 1104 and a number of screw holes 1202. Screw holes 1202 are used to fasten the wall cleat 1102 to a mounting wall.

Figure 13:
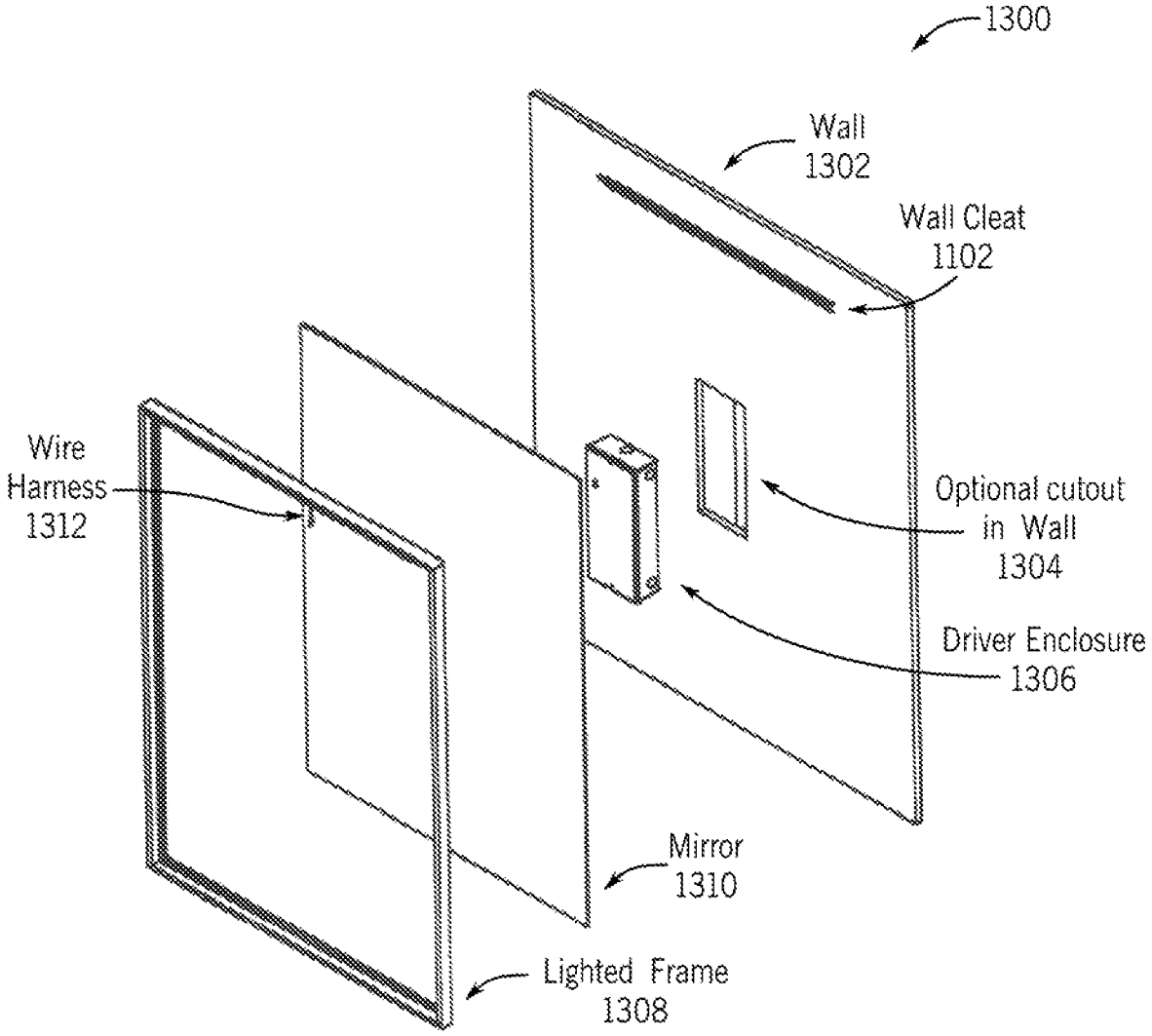
FIG. 13 illustrates an exploded view of a front lit mirror, according to embodiments of the invention.

FIG. 13 illustrates, generally at 1300, an exploded view of a front lit mirror, according to embodiments of the invention. With reference to FIG. 1300 an arrangement of the major components of a front lit mirror is illustrated. A mounting surface, such as a wall, is indicated at 1302. The wall is prepared with a cutout 1304. A light source drive enclosure is indicated at 1306. The cutout 1304 is sized to receive the light source driver enclosure 1306. A wall cleat 1102 is mounted on the wall. The wall cleat has been described in the preceding figures. The driver enclosure 1306 is a driver enclosure that contains a driver that powers the lighting and can be surface or recess mounted. A mirror is illustrated at 1310. A lighted frame 1308 includes a wiring harness 1312 and light sources as previously described. Those of skill in the art will note that the lighted frame is assembled around the mirror 1310 capturing an edge of the mirror in the mirror channels of the plurality of extruded frame members as previously described.

FIG. 14 illustrates, generally at 1400, an assembled front lit mirror product, according to embodiments of the invention. With reference to FIG. 14, the front lit mirror of FIG. 13 is now illustrated as fully assembled and mounted on the wall 1302. The front lit mirror 1400 shows the mirror 1310 mounted into the mirror channels of a front lighted frame 1308 with diffusers 1410 installed into the light source channels. The major components of the assembled product include the lighted frame, mirror, recessed or surface mounted driver enclosure, and wall cleat, as illustrated in FIG. 13. The final product without the optional decorative frame is illustrated mounted to a wall in FIG. 14.

Figure 15:
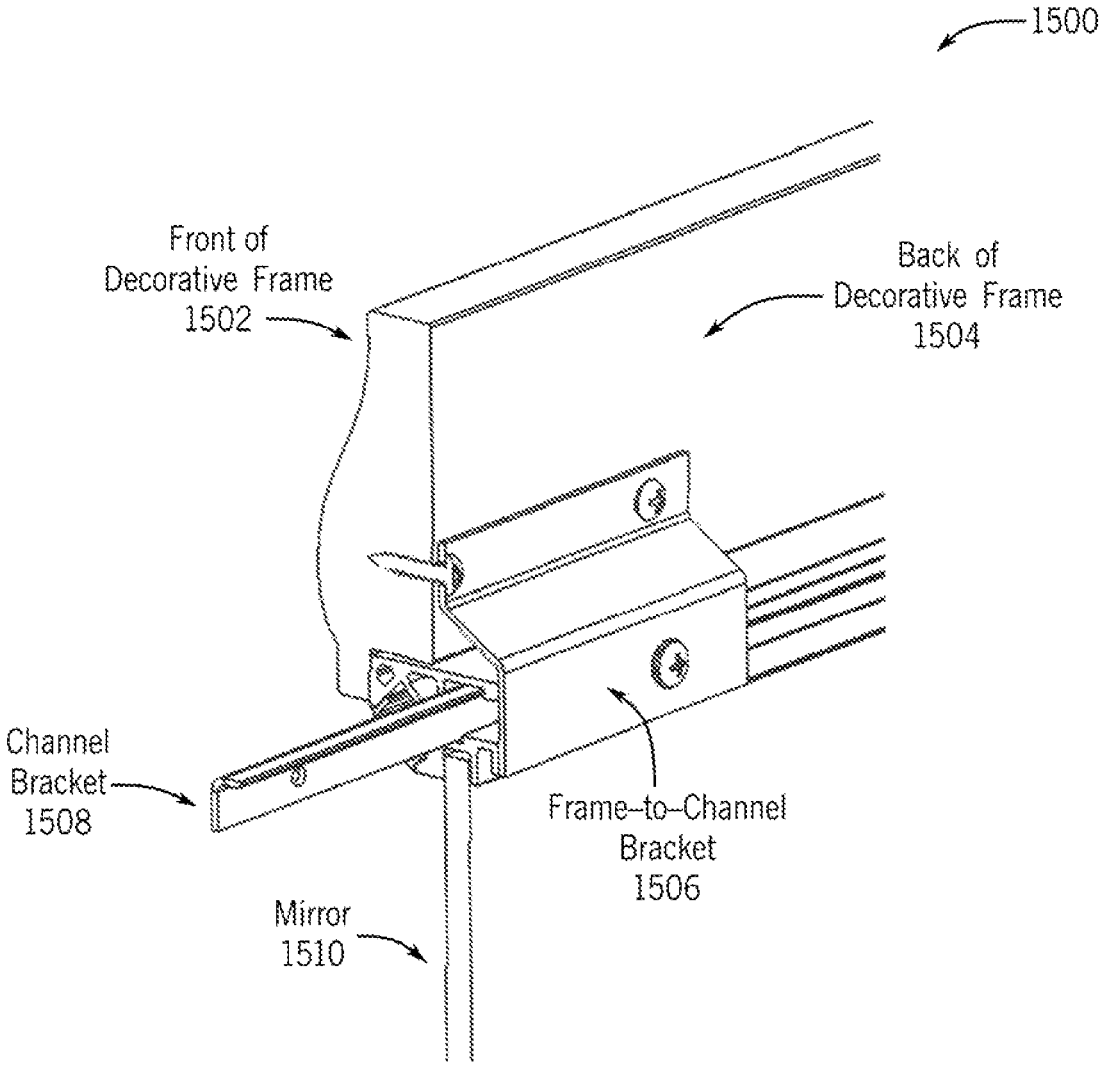
FIG. 15 illustrates a decorative frame facade, according to embodiments of the invention.

FIG. 15 illustrates, generally at 1500, a decorative frame facade, according to embodiments of the invention. With reference to FIG. 15, a decorative frame attachment illustrates the components necessary to add a decorative frame facade to the lighted extruded frame. A channel bracket 1508 is illustrated after it is inserted into the component channel of an extruded frame member. A frame-to-channel-bracket 1506 is mechanically coupled to the channel bracket 1508 with mechanical couplers such as screws. A decorative frame has a front 1502 side that a user sees and a back side 1504 that is secured to the frame-to-channel bracket 1506. A mirror 1510 is shown inserted into a mirror channel of the extruded frame section illustrated in FIG. 15. In various embodiments, different decorative frame designs can be attached to the front lit mirror through the use of the channel brackets 1508.

In various embodiments, the mirror channel 312 illustrated in FIG. 3 holds the mirror securely in place inside the perimeter of the extruded frame when the extruded frame members are connected together at their respective ends. The hanger channel illustrated at 314 is used to hang the finished product on a wall cleat that is in turn affixed to a wall as illustrated in FIGS. 11 and 13.

The component channel 316 illustrated in FIG. 3 has multiple purposes. As previously described, wiring from a light source, such as an LED strip, passes through a hole in the light source channel to the component channel illustrated for example, in FIG. 5 and FIG. 6, where the wiring is routed through the component channel to the top of the product's extruded frame member, where it passes out of the component channel through a wire harness notch in the hanger channel illustrated in FIG. 9 and FIG. 10, to the junction box illustrated 908 or 1008. The junction box allows the wiring connecting the light sources, such LED Strips, to be connected to the driver which in turn is connected to power.

Wiring is held in place throughout the component channel with a number of devices, such as but not limited to, short Latex tubing that are pressed into the Component Channel over the wiring, as illustrated at 910 (FIG. 9) and 1010 (FIG. 10).

In various embodiments, a plurality of extruded frame members are connected together within the component channel with one or more brackets, such as L-Brackets illustrated in FIGS. 7, 8 and 9.

One or more channel brackets 1508 illustrated in FIG. 15 can be inserted into the component channel as part of a mechanism to attach a decorative frame illustrated in 1502/1504 to the extruded frame member. To accomplish assembly, a frame-to-channel bracket illustrated in FIG. 15 is attached to an extruded frame member with a fastener, such as a bolt or a screw into the channel bracket illustrated in FIG. 15 and screwed into the back of the decorative frame illustrated FIG. 15.

Figure 16:
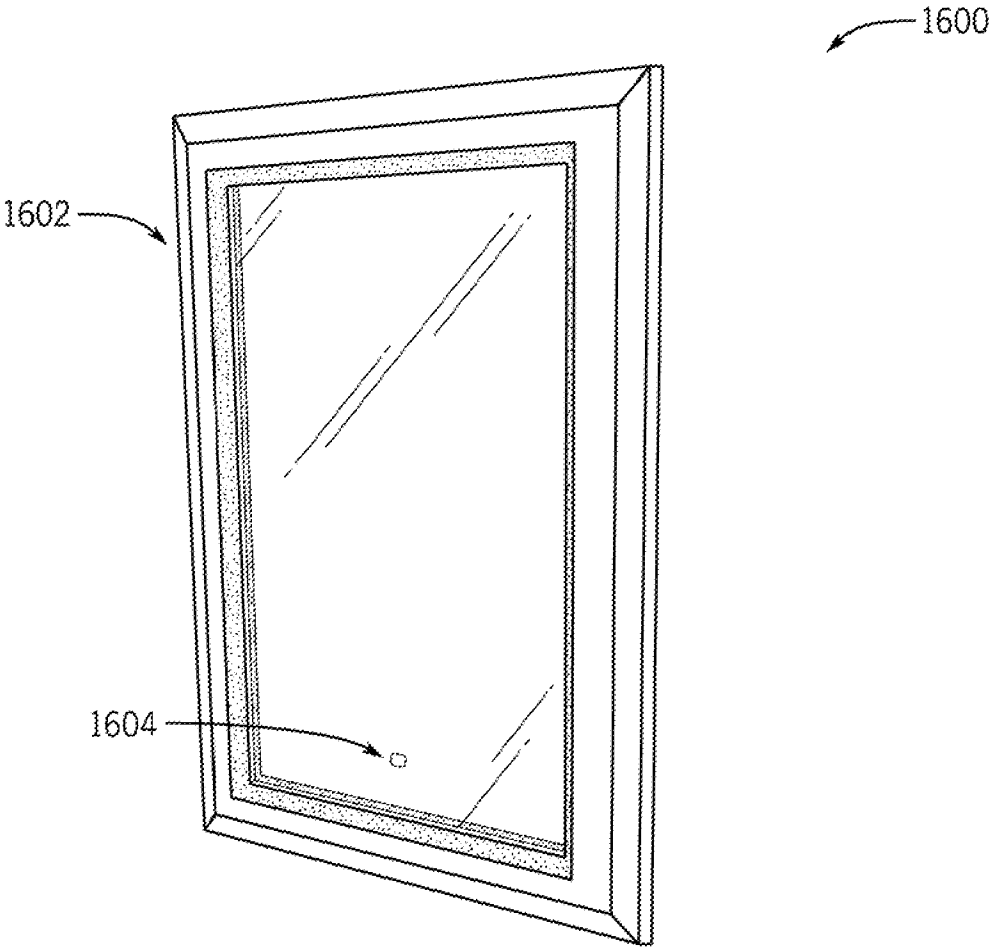
FIG. 16 illustrates an assembled front lit mirror with decorative frame, according to embodiments of the invention.

FIG. 16 illustrates, generally at 1600, an assembled front lit mirror with decorative frame, according to embodiments of the invention. The illustration shown in FIG. 16 is of the assembled product mounted to a wall with a decorative frame 1602 attached. Also illustrated in the illustration is a touch control 1604 to operate the lighting that is built into the front lit mirror extruded frame.

The final product can be enhanced with various options in addition to the decorative frame, including, but not limited to: a digital clock, a defogger, mirror-surface-touch controls for dimming illustrated in FIG. 16, controls for audio streaming, and a TV.

Variations of the front lit mirror include providing lighting only on the top or bottom of the mirror frame, lighting on the top and bottom of the mirror frame, lighting on one side of the mirror frame, and lighting on both sides of the mirror frame. These lighting variations are achieved by the use of an extrusion that does not include the light source channel (LED channel) or the diffuser channels, as illustrated below in FIG. 17. Any profile shape can be created for the extruded frame members, such as square, rectangle, triangle, octagon, cross, etc.

Figure 17:
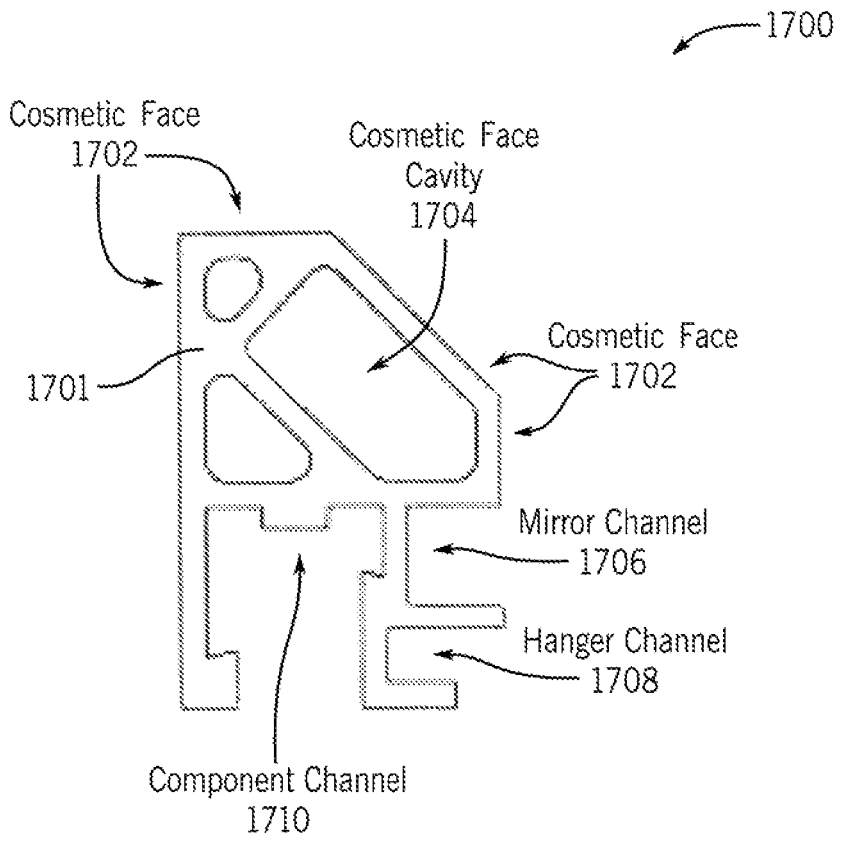
FIG. 17 illustrates a non-lighted extruded frame member, according to embodiments of the invention.

FIG. 17 illustrates, generally at 1700, a non-lighted extruded frame member according to embodiments of the invention. With reference to FIG. 17, in one or more embodiments, cosmetic faces 1702 are polished finished faces of the extruded frame member 1701 that are visible to a person using the mirror. A cosmetic face cavity 1704 illustrates a cavity below a cosmetic face. A mirror channel 1706 is used to secure the extruded frame member 1701 to a mirror. A hanger channel 1708 illustrates a channel on the extruded frame member used to hang the mirror assembly on a wall cleat for mounting. A component channel 1710 illustrates the component channel used for wiring, latex tubing to secure wiring, channel bracket for decorative frame, and for brackets such as L-brackets used to secure each extruded frame member to an adjacent extruded frame member thereby facilitating the construction of a multisided front lit frame for a mirror. Thus, there is no light source channel in the extruded frame member 1701. Neither is the extruded frame member 1701 made from a transparent or translucent material when it is desirable to provide a non-lighted extruded frame member.

In various embodiments, one or more non-lighted extruded frame members are combined with one or more lighted extruded frame members to create various amounts of illumination from the frame that surrounds a mirror.

Various alternative embodiments of the invention are obtained by increasing or decreasing the angle 320 between the LED channel 306 relative to the mirror channel 312, illustrated in FIG. 3, in order to change a direction of light radiated onto a person using the mirror.

Various alternative embodiments of the invention are obtained by changing a shape a length of the cosmetic faces illustrated at 304.

Various alternative embodiments of the invention include changing a shape of the diffuser face illustrated at 404 (FIG. 4). Examples include, but are not limited to: a diffuser face that is flat instead of convex; a diffuser face that has a larger or smaller convex angle than that illustrated at 404; a diffuser face that is rectangular instead of convex; a diffuser face that is triangular instead of convex; a diffuser face that is multi-angular instead of convex.

Various alternative embodiments of the invention are obtained by changing the locking mechanism that secures the diffuser to the LED channel. Examples include, but are not limited to: changing the location of the diffuser channels illustrated at 308; increasing the number of diffuser channels to receive additional diffuser locking tabs; removing the diffuser channels and using alternate mechanisms to secure the diffuser to the extruded frame member, such as with tape or glue.

Various alternative embodiments of the invention are obtained when the diffuser pockets illustrated in 310 are not extruded.

Various alternative embodiments of the invention are obtained when the LED Channel 306 is used to run internal wiring.

Referring to FIG. 3 and FIG. 17, various alternative embodiments of the invention are obtained when the LED channel illustrated at 306 or the cosmetic face cavity illustrated in 1704 are used to run internal wiring, while the component channel illustrated at 316 and 1710 are used for LED lighting in order to cause lighting to illuminate a wall behind the mirror.

Referring to FIG. 3, FIG. 11, and FIG. 12, various alternative embodiments of the invention are obtained when the mirror channel illustrated at 312 is used to hang the final product to the wall cleat illustrated in FIG. 11 or FIG. 12.

Referring to FIG. 3 various alternative embodiments of the invention are obtained when the LED Channel illustrated at 306 is used to house speakers, motion detection, photo detection, touch controls, buttons, or voice controls.

Referring to FIG. 17, various alternative embodiments of the invention are obtained when the cosmetic face cavity illustrated at 1704 is used to house touch controls, buttons, or other electronics.

Referring to FIG. 15, various alternative embodiments of the invention are obtained when an extruded frame member is used to attach a decorative frame to it without the use of a channel bracket or frame-to-channel bracket illustrated in FIG. 15, such as with adhesives in one or more embodiments.

Referring to FIG. 3 and FIG. 13, various alternative embodiments of the invention are obtained when the driver enclosure illustrated at 1306 in FIG. 13 is attached to the back of the mirror 1310 or the driver itself is attached within a component channel, such as illustrated at 316 in FIG. 3.

Various alternative embodiments of the invention are obtained when the extruded frame member illustrated in FIG. 3 is not made of metal, but is made of some other material, such as plastic.

Various alternative embodiments of the invention are obtained when the extruded frame member illustrated in FIG. 3 is made of a material that is translucent and allows light from the LED channel to glow through the extrusion.

Various alternative embodiments of the invention are obtained when the standoff assembly illustrated in FIG. 9 is attached to the wall using tape, magnets, Velcro, or a clip.

Various alternative embodiments of the invention are obtained when the wire harness notch is not in the center of the top frame extrusion, but offset to either side, or on any other extruded frame member.

Various alternative embodiments of the invention are obtained when the wire harness notch is cut into more than one extruded frame member with wire harnesses taking different paths to a power source.

In various embodiments a frame of a framed front-lit mirror enables the assembly of the entire framed mirror. The framed mirror is made with a plurality of extrusions of material containing multiple channels. The plurality of extrusions encircles a mirror around a perimeter of the mirror. Electrical components and mechanical component are utilized and contained within a volume of the frame mirror to provide a lighted frame.

In various embodiments a framed lit mirror radiates light that shines against a wall that the mirror is mounted on. The frame enables the assembly of the entire unit. The unit includes an extrusion of material containing multiple channels, a mirror, electrical components, and mechanical components.

In various embodiments, an extruded frame assembly is mountable to a wall. In various embodiments, the extrudable frame assembly includes a mirror, electrical components, and lighting components. The frame assembly includes one or more extrusions and can have a cosmetic face and channels, where the extrusion is cut into sticks to assemble a frame around a mirror. The extrusion includes a channel to contain LED lighting strips. Small channels within a larger channel are used to secure a diffuser that allows light to shine through the diffuser but masks individual LED elements. One or more holes are used to provide passage between channels that allows the LED strip to be connected to a wire that is routed behind the channel housing the LED strip to another channel. A component channel allows wiring to be hidden from the front of the mirror and allows the wiring to be secured within the channel. During assembly individual frame sticks are connected together at their ends. A bracket can be inserted into a channel to provide a mounting mechanism for an optional decorative frame that covers the metal frame. In the various embodiments described herein, any type of solid-state lighting can be used for a light source. Similarly, any type of bulb lighting can be used for a light source. Light sources can be provided with different light intensity according to a given design for a front lit mirror. Thus, in some designs it will be advantageous to provide high intensity and in other designs it will be advantageous to provide lower intensity. In some designs control of the light intensity is provided by electronics included with the front lit mirror.

As used in this description, "one embodiment" or "an embodiment" or similar phrases means that the feature(s) being described are included in at least one embodiment of the invention. References to "one embodiment" in this description do not necessarily refer to the same embodiment; however, neither are such embodiments mutually exclusive. Nor does "one embodiment" imply that there is but a single embodiment of the invention. For example, a feature, structure, act, etc. described in "one embodiment" may also be included in other embodiments. Thus, the invention may include a variety of combinations and/or integrations of the embodiments described herein.

While the invention has been described in terms of several embodiments, those of skill in the art will recognize that the invention is not limited to the embodiments described, but can be practiced with modification and alteration within the spirit and scope of the appended claims. The description is thus to be regarded as illustrative instead of limiting.

What is claimed is:

1. A front lit mirror component, comprising:

an extruded frame member, the extruded frame member further comprising:

a mirror channel, the mirror channel extending along a longitudinal direction of the extruded frame member, the mirror channel is sized to receive an edge of a mirror; and a light source channel, the light source channel extends along the longitudinal direction, an angle exists between the mirror channel and the light source channel, the light source channel is positioned in front of the mirror channel and the light source channel is sized to receive a light source, such that when the light source is in an on-state light radiates from the light source channel.

2. The front lit mirror component of claim 1, the extruded frame member further comprising:

a wire passage, the wire passage extends along the longitudinal direction.

3. The front lit mirror component of claim 2, wherein the wire passage is selected from the group consisting of a channel and a cavity.

4. The front lit mirror component of claim 3, further comprising:

a light source.

5. The front lit mirror component of claim 4, wherein the light source is selected from the group consisting of a solid-state lighting device, a light emitting diode (LED), an organic light emitting diode (OLED), a bulb type lighting device, and an incandescent bulb.

6. The front lit mirror component of claim 5, further comprising:

a wire harness, the wire harness is coupled to the light source.

7. The front lit mirror component of claim 6, the light source channel further comprising:

a hole in the light source channel, the hole is sized to permit the wire harness to pass through the hole.

8. The front lit mirror component of claim 6, the extruded frame member further comprising:

a notch, the notch is sized to accommodate a thickness of the wire harness.

9. The front lit mirror component of claim 1, the extruded frame member further comprising:

a hanger channel, the hanger channel has a width and is sized to receive a hanger bracket.

10. The front lit mirror component of claim 1, the extruded frame member further comprising:

a component channel, the component channel has a width and is sized to receive a frame member connector.

11. The front lit mirror component of claim 1, wherein the extruded frame member is made from a material selected from the group consisting of metal and plastic.

12. The front lit mirror component of claim 1, further comprising:

a diffuser, the diffuser is configured to couple into the light source channel.

13. The front lit mirror component of claim 12, wherein the diffuser is made from a material selected from the group consisting of plastic and glass.

14. A front lit mirror component, comprising:

an extruded frame member, the extruded frame member is made from a translucent material and has an exterior surface, the extruded frame member further comprising:

a channel, the channel extending along a longitudinal direction of the extruded frame member, the channel is sized to receive an edge of a mirror; and a cavity, the cavity extending along the longitudinal direction, the cavity is positioned in front of the channel and the cavity is sized to receive a light source, such that when the light source is in an on-state light passes through the extruded frame member and illuminates the exterior surface.

15. The front lit mirror component of claim 14, the extruded frame member further comprising:

a wire passage, the wire passage extends along the longitudinal direction.

16. The front lit mirror component of claim 15, wherein the wire passage is selected from the group consisting of a channel and a cavity.

17. The front lit mirror component of claim 16, further comprising:

a light source.

18. The front lit mirror component of claim 17, wherein the light source is selected from the group consisting of a solid-state lighting device, a light emitting diode (LED), an organic light emitting diode (OLED), a bulb type lighting device, and an incandescent bulb.

19. The front lit mirror component of claim 18, further comprising:

a wire harness, the wire harness is coupled to the light source.

20. The front lit mirror component of claim 19, the cavity further comprising:

a hole in the cavity, the hole is sized to permit the wire harness to pass through the hole.

21. The front lit mirror component of claim 19, the extruded frame member further comprising:

a notch, the notch is sized to accommodate a thickness of the wire harness.

22. The front lit mirror component of claim 14, the extruded frame member further comprising:

a hanger channel, the hanger channel has a width and is sized to receive a hanger bracket.

23. The front lit mirror component of claim 14, the extruded frame member further comprising:

a component channel, the component channel has a width and is sized to receive a frame member connector.

24. The front lit mirror component of claim 14, wherein the extruded frame member is made from a material selected from the group consisting of a transparent material and a translucent material.

25. The front lit mirror component of claim 14, further comprising:

a diffuser, the diffuser covers a portion of the exterior surface.

26. The front lit mirror component of claim 25, wherein the diffuser is made from a material selected from the group consisting of plastic and glass.

27. The front lit mirror component of claim 14, further comprising:

opaque material, the opaque material is attached to a second portion of the exterior surface of the extruded frame member, the opaque material prevents light from radiating from the second portion when the light source is in an on-state.

28. A front lit mirror, comprising:

a plurality of front lit mirror components, each front lit mirror component of the plurality, further comprising:

an extruded frame member, the extruded frame member, further comprising:

a mirror channel, the mirror channel extends in a longitudinal direction along the extruded frame member, the mirror channel is sized to receive an edge of a mirror;

a light source channel, the light source channel extends in the longitudinal direction, an angle exists between the mirror channel and the light source channel, the light source channel is positioned in front of the mirror channel and the light source channel is sized to receive a light source; and a diffuser, the diffuser is configured to engage with the light source channel, such that when the light source is in an on-state, light passes through the diffuser to a front side of the front lit mirror, the plurality of front lit mirror components are configured to couple together end-to end thereby forming a continuous frame around the mirror.

29. The front lit mirror of claim 28, the plurality of front lit mirror components further comprising:

at least one extruded frame member, the at least one extruded frame member is made from a translucent material and the at least one extruded frame member utilizes a cavity to house a light source.

30. The front lit mirror of claim 29, the plurality of front lit mirror components further comprising:

at least one extruded frame member that is not illuminated.

31. The front lit mirror of claim 28, the plurality of front lit mirror components further comprising:

a decorative frame, the decorative frame is coupled to at least one extruded frame member of the plurality.

32. A front lit mirror, comprising:

a plurality of front lit mirror components, each front lit mirror component of the plurality, further comprising:

an extruded frame member, the extruded frame member, further comprising:

a channel, the channel extending along a longitudinal direction of the extruded frame member, the channel is sized to receive an edge of a mirror; and a cavity, the cavity extending along the longitudinal direction, the cavity is positioned in front of the channel and the cavity is sized to receive a light source, such that when the light source is in an on-state, light passes through the extruded frame member to a front side of the front lit mirror, the plurality of front lit mirror components are configured to couple together end-to end thereby forming a continuous frame around the mirror.

33. The front lit mirror of claim 32, the plurality of front lit mirror components further comprising:

at least one extruded frame member, the at least one extruded frame member is made with a light source channel to house a light source; and a diffuser, the diffuser is coupled to the at least one extruded frame member over an aperture of the light source channel.

34. The front lit mirror of claim 33, the plurality of front lit mirror components further comprising:

at least one extruded frame member that is not illuminated.

35. The front lit mirror of claim 32, the plurality of front lit mirror components further comprising:

a decorative frame, the decorative frame is coupled to at least one extruded frame member of the plurality.

* * * * *